US010746079B2

(12) United States Patent
Okamoto

(10) Patent No.: US 10,746,079 B2
(45) Date of Patent: Aug. 18, 2020

(54) EXHAUST GAS SENSOR ARRANGEMENT STRUCTURE AND EXHAUST CONTROL SYSTEM

(71) Applicant: SUZUKI MOTOR CORPORATION, Hamamatsu-shi, Shizuoka (JP)

(72) Inventor: Masato Okamoto, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 16/198,059

(22) Filed: Nov. 21, 2018

(65) Prior Publication Data

US 2019/0162103 A1 May 30, 2019

(30) Foreign Application Priority Data

Nov. 24, 2017 (JP) ..... 2017-225557

(51) Int. Cl.
*F01N 3/28* (2006.01)
*F01N 13/00* (2010.01)
(Continued)

(52) U.S. Cl.
CPC ..... *F01N 13/008* (2013.01); *F01N 3/2892* (2013.01); *F02D 9/04* (2013.01);
(Continued)

(58) Field of Classification Search
CPC ..... F01N 13/008; F01N 3/2892; F01N 9/04; F01N 2560/02; F01N 2560/025;
(Continued)

(56) References Cited

U.S. PATENT DOCUMENTS 5,060,473 A 10/1991 Nakagawa ..... 60/277
7,818,964 B2 * 10/2010 Muramatsu ..... F01N 1/003 60/324

(Continued)

FOREIGN PATENT DOCUMENTS

EP 3 165 742 A1 7/2015
JP 2006-307693 A 11/2006
WO WO 2016/002960 A1 1/2016

OTHER PUBLICATIONS

Indian Office Action dated Mar. 19, 2020, issued by the Indian Patent Office in corresponding application IN 201814043897.

*Primary Examiner* — Thai Ba Trieu
*Assistant Examiner* — Dapinder Singh
(74) *Attorney, Agent, or Firm* — Stein IP, LLC

(57) ABSTRACT

The present invention relates to an exhaust gas sensor arrangement structure comprising: an exhaust pipe 6 extending from an engine 3 to form a part of an exhaust flow path; an exhaust valve 7 that adjusts an aperture of the exhaust flow path; and a first exhaust gas sensor 8*a* that detects a predetermined component in an exhaust gas flowing through the exhaust flow path. The first exhaust gas sensor has a detector 80 arranged to protrude into the exhaust flow path. The exhaust valve includes a plate-like valve body 70 that expands and reduces a flow path cross section of the exhaust flow path, and a rotating shaft 71 extending in a direction intersecting with an axial direction of the exhaust flow path and serving as a rotation center of the valve body. A downstream end of the valve body approaches the detector as the valve body is rotated in a direction of reducing the flow path cross section.

15 Claims, 9 Drawing Sheets

(51) Int. Cl.
*F02D 9/04* (2006.01)
*F02D 41/14* (2006.01)
*F02D 41/30* (2006.01)

(52) U.S. Cl.
CPC ..... *F02D 41/1439* (2013.01); *F02D 41/3005* (2013.01); *F01N 2240/36* (2013.01); *F01N 2550/00* (2013.01); *F01N 2560/02* (2013.01); *F01N 2560/025* (2013.01); *F01N 2590/04* (2013.01); *F02D 41/1441* (2013.01); *F02D 41/1454* (2013.01)

(58) Field of Classification Search
CPC ..... F01N 2240/36; F01N 2550/00; F01N 2590/04; F02D 41/1439; F02D 41/3005; F02D 41/1441; F02D 41/1454; F02D 9/04
USPC ..... 60/295, 299, 323
See application file for complete search history.

(56) References Cited

U.S. PATENT DOCUMENTS

| | | | | |
|---|---|---|---|---|
| 9,238,999 | B2 * | 1/2016 | Stellwagen | F02B 37/12 |
| 10,233,853 | B2 * | 3/2019 | Muramatsu | F01N 3/20 |
| 2006/0242952 | A1 * | 11/2006 | Muramatsu | F01N 1/003 60/299 |
| 2017/0350335 | A1 * | 12/2017 | Muramatsu | F01N 3/20 |

* cited by examiner

WHEN EXHAUST VALVE IS CLOSED

EXHAUST GAS SENSOR ARRANGEMENT STRUCTURE AND EXHAUST CONTROL SYSTEM

CROSS-REFERENCE TO RELATED APPLICATION

This application claims priority to Japanese Patent Application No. 2017-225557 filed on Nov. 24, 2017, which is incorporated herein by reference in its entirety.

BACKGROUND

Technical Field

The present invention relates to an exhaust gas sensor arrangement structure and an exhaust control system.

Related Art

Conventionally, in vehicle exhaust systems, a technology of detecting an exhaust gas component by an exhaust gas sensor attached to an exhaust pipe has been proposed (see JP 2006-307693 A, for example). In JP 2006-307693 A, the exhaust gas sensor is arranged downstream of an exhaust throttle valve that controls an exhaust flow rate in the exhaust pipe. The exhaust gas sensor detects the oxygen concentration in the exhaust gas and inputs a detection value to a control CPU. The control CPU controls a fuel injection quantity of a fuel injection device on the basis of the oxygen concentration.

SUMMARY

By the way, vehicle engine exhaust systems are required to more accurately detect the exhaust gas component with the recent emission control. However, restriction is caused on arrangement of the exhaust gas sensor depending on the constitution of other parts of the exhaust device, such as a muffler and a catalyst, and difficulty in arranging the exhaust gas sensor at a position where the exhaust gas component can be appropriately detected is expected.

The present invention has been made in view of the above point, and an object of the present invention is to provide an exhaust gas sensor arrangement structure and an exhaust control system capable of arranging the exhaust gas sensor without impairing detection accuracy of an exhaust gas component.

An exhaust gas sensor arrangement structure according to an aspect of the present invention comprises: an exhaust pipe extending from an engine to form a part of an exhaust flow path; an exhaust valve that adjusts an aperture of the exhaust flow path; and an exhaust gas sensor that detects a predetermined component in an exhaust gas flowing through the exhaust flow path. The exhaust gas sensor has a detector arranged to protrude into the exhaust flow path. The exhaust valve includes a plate-like valve body that expands and reduces a flow path cross section of the exhaust flow path, and a rotating shaft extending in a direction intersecting with an axial direction of the exhaust flow path and serving as a rotation center of the valve body. A downstream end of the valve body approaches the detector as the valve body is rotated in a direction of reducing the flow path cross section.

According to the present invention, the exhaust gas sensor can be arranged without impairing the detection accuracy of the exhaust gas component.

DETAILED DESCRIPTION

Hereinafter, embodiments of the present invention will be described in detail with reference to the accompanying drawings. Note that, in the following description, an example in which the present invention is applied to a sport-type motorcycle will be described. However, the application target is not limited to the example and can be changed. For example, the exhaust gas sensor arrangement structure and the exhaust control system according to the present invention may be applied to another type of motorcycle, a buggy-type automatic tricycle, an automatic four-wheeled vehicle, or the like. In regard to directions, the arrow FR represents the front of the vehicle, the arrow RE represents the rear of the vehicle, the arrow L represents the left of the vehicle, the arrow R represents the right of the vehicle, the arrow UP represents the upper side of the vehicle, and the arrow LO represents the lower side of the vehicle. Further, in the following drawings, a part of a configuration is omitted for convenience of description.

Figure 1:
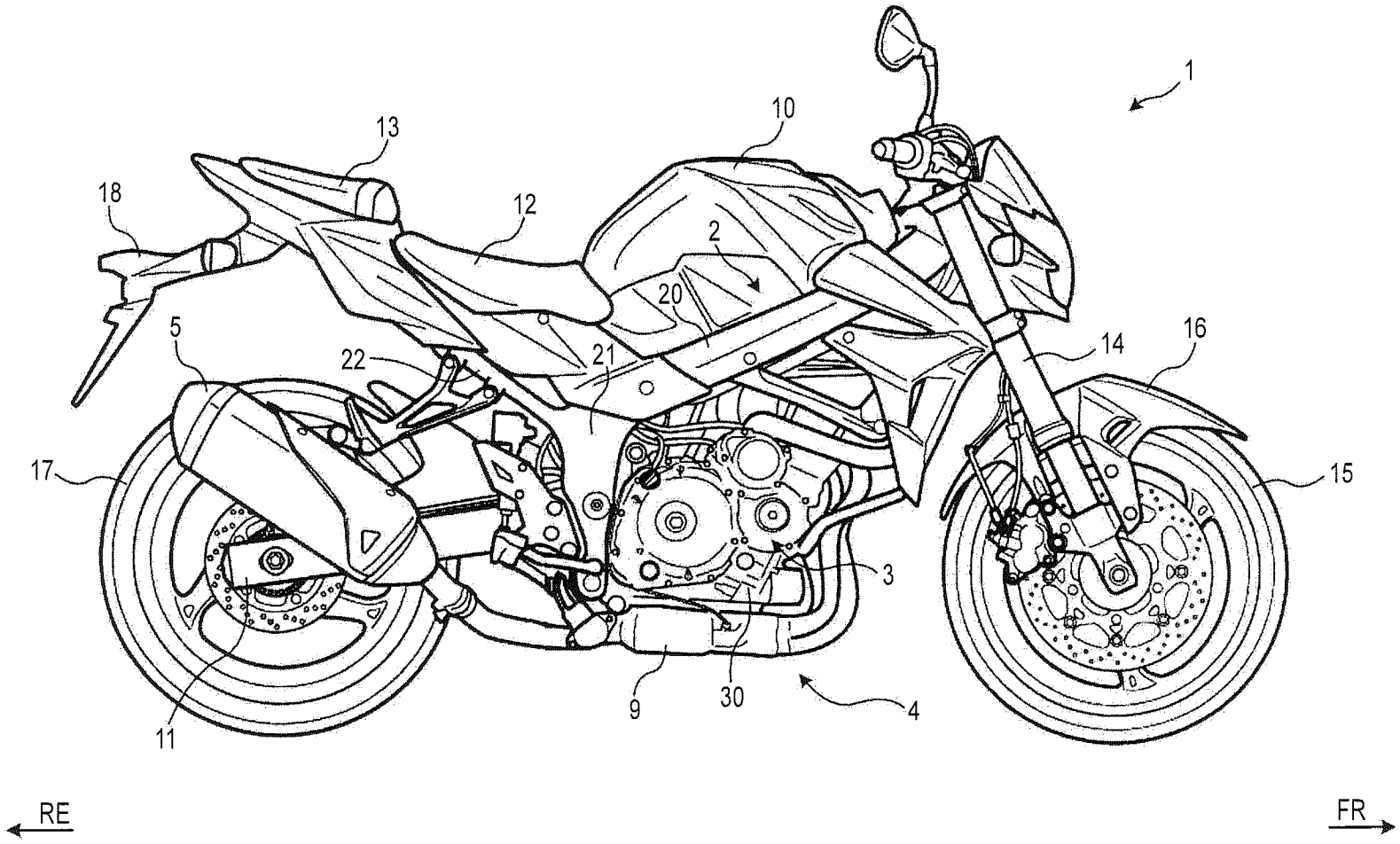
FIG. 1 is a left side view illustrating a schematic configuration of a motorcycle.

A schematic configuration of a motorcycle to which the present embodiment is applied will be described with reference to FIG. 1. FIG. 1 is a left side view illustrating a schematic configuration of a motorcycle.

As illustrated in FIG. 1, a motorcycle 1 is constituted by suspending an engine 3 as a part of a power unit on a vehicle body frame 2 on which various parts such as an electrical system are mounted. The engine 3 is constituted by, for example, a parallel four-cylinder engine. The engine 3 is constituted by attaching a cylinder head and a cylinder head cover (not illustrated) to an upper portion of an engine case 30 in which a crankshaft (not illustrated) and the like are accommodated. An oil pan (not illustrated) is provided in a lower portion of the engine case 30.

The vehicle body frame 2 is a twin spar-type frame formed of iron, an aluminum alloy, or the like, and suspends the engine 3 as described above to obtain rigidity of the vehicle body as a whole. The vehicle body frame 2 extends from the front to the rear as a whole and has a shape curving downward at the rear end side.

Specifically, the vehicle body frame 2 includes a main frame 20 branched and extending into right and left two directions from a head pipe (not illustrated) toward the rear, and a body frame 21 extending downward from a rear end of the main frame 20. A fuel tank 10 is arranged above the main frame 20. A swing arm 11 is swingably supported at a substantially central portion in an up and down direction of the body frame 21. The swing arm 11 extends rearward.

A seat rail (not illustrated) and a backstay 22 extending rearward and upward are provided on an upper end of the body frame 21. The seat rail is provided with a rider seat 12 and a pillion seat 13 connected to the fuel tank 10.

A pair of left and right front forks 14 is steerably supported by the head pipe via a steering shaft (not illustrated). A front wheel 15 is rotatably supported by lower portions of the front forks 14, and an upper portion of the front wheel 15 is covered with a front fender 16. A rear wheel 17 is rotatably supported by a rear end of the swing arm 11. An upper portion of the rear wheel 17 is covered with a rear fender 18.

An exhaust pipe 4 and a muffler 5 are connected to exhaust ports of the cylinder head. A plurality (four in the present embodiment) of the exhaust pipes 4 extends downward from the exhaust ports, bends rearward at a front lower side of the engine 3, is then brought into one, and extends toward the rear of the vehicle. The muffler 5 is connected to a rear end of the exhaust pipes 4.

Figure 2:
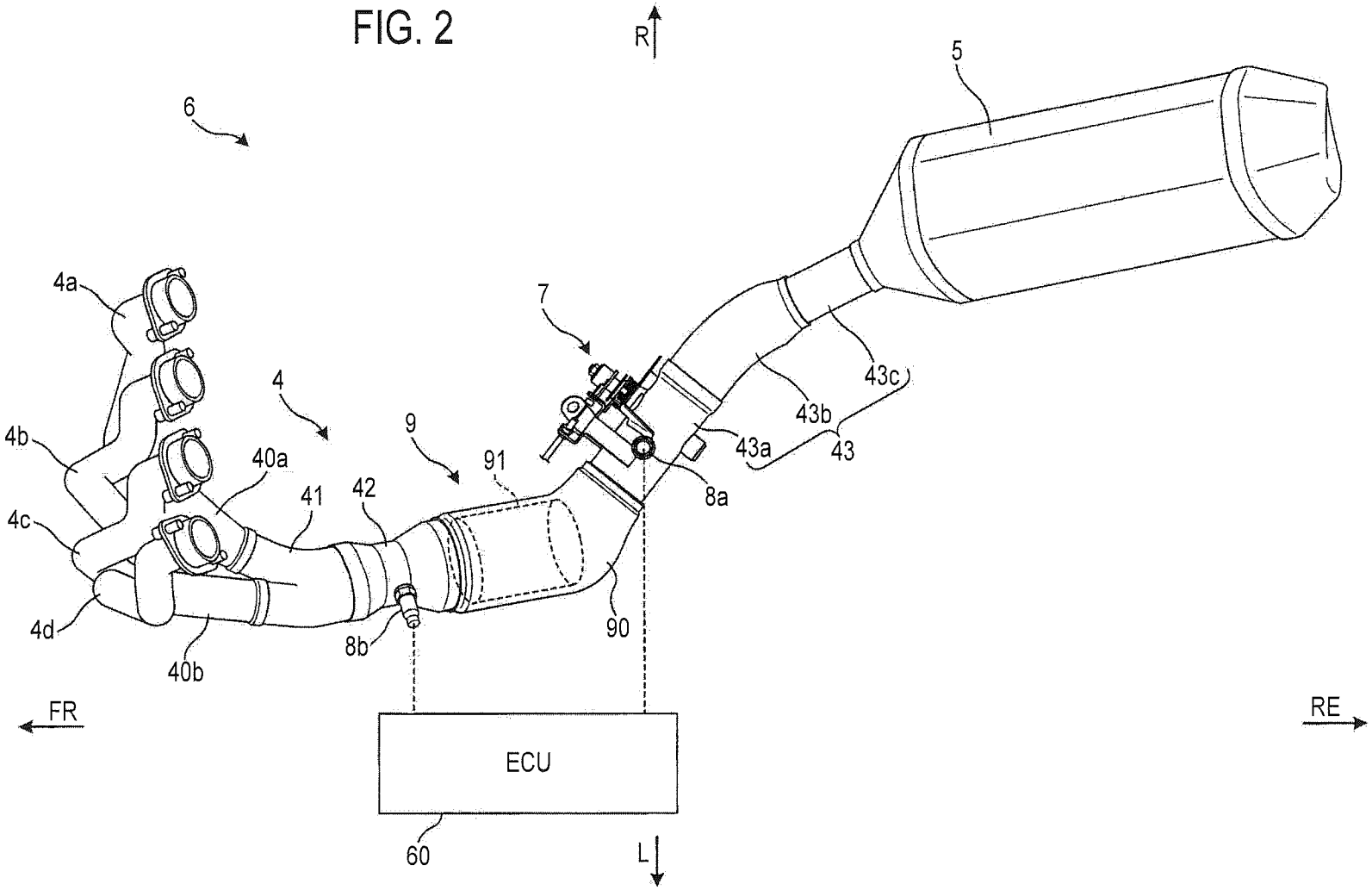
FIG. 2 is a schematic perspective view of an exhaust system of a motorcycle according to a first embodiment.
Figure 3:
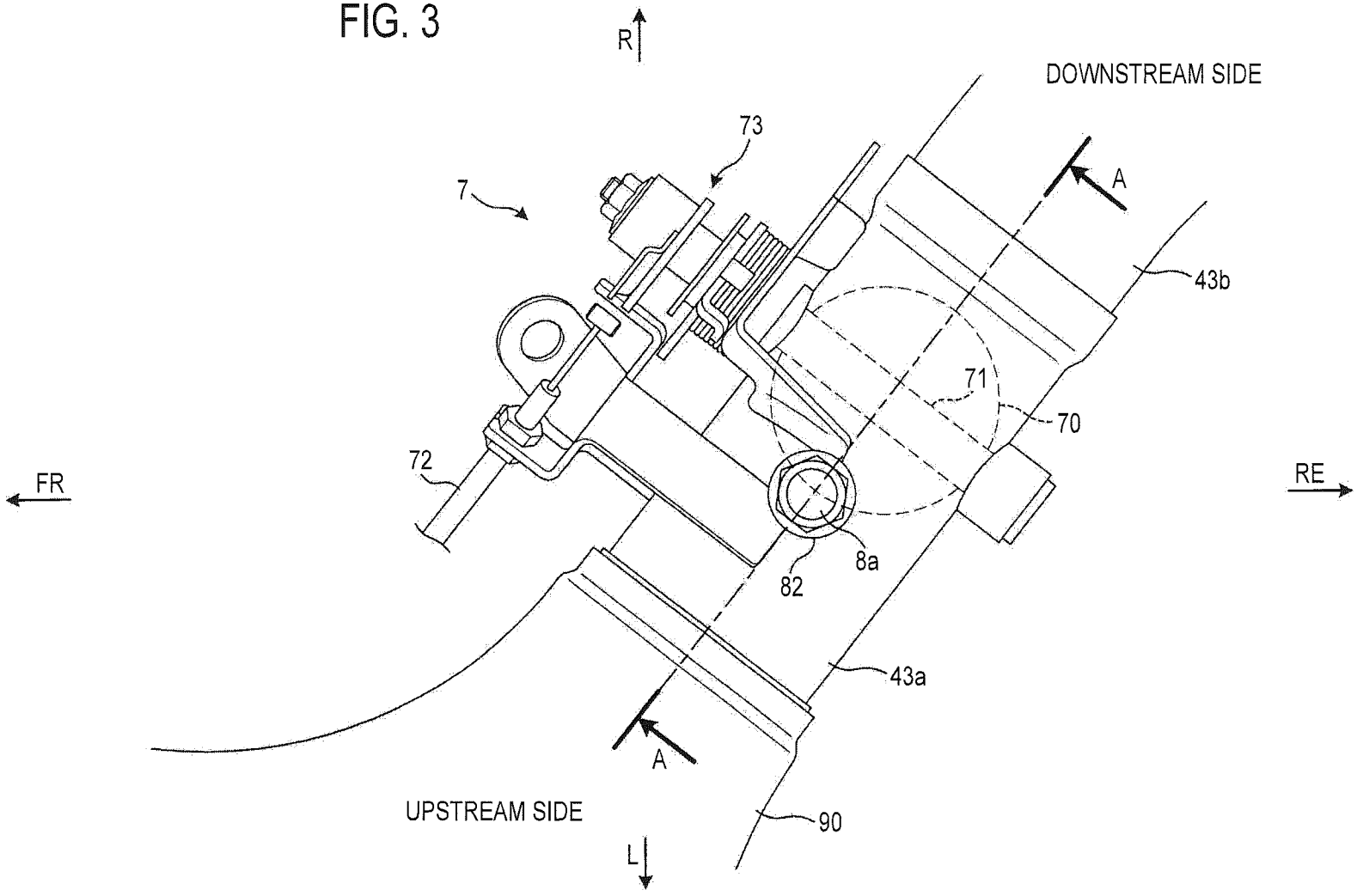
FIG. 3 is a partially enlarged view of FIG. 2.
Figure 4:
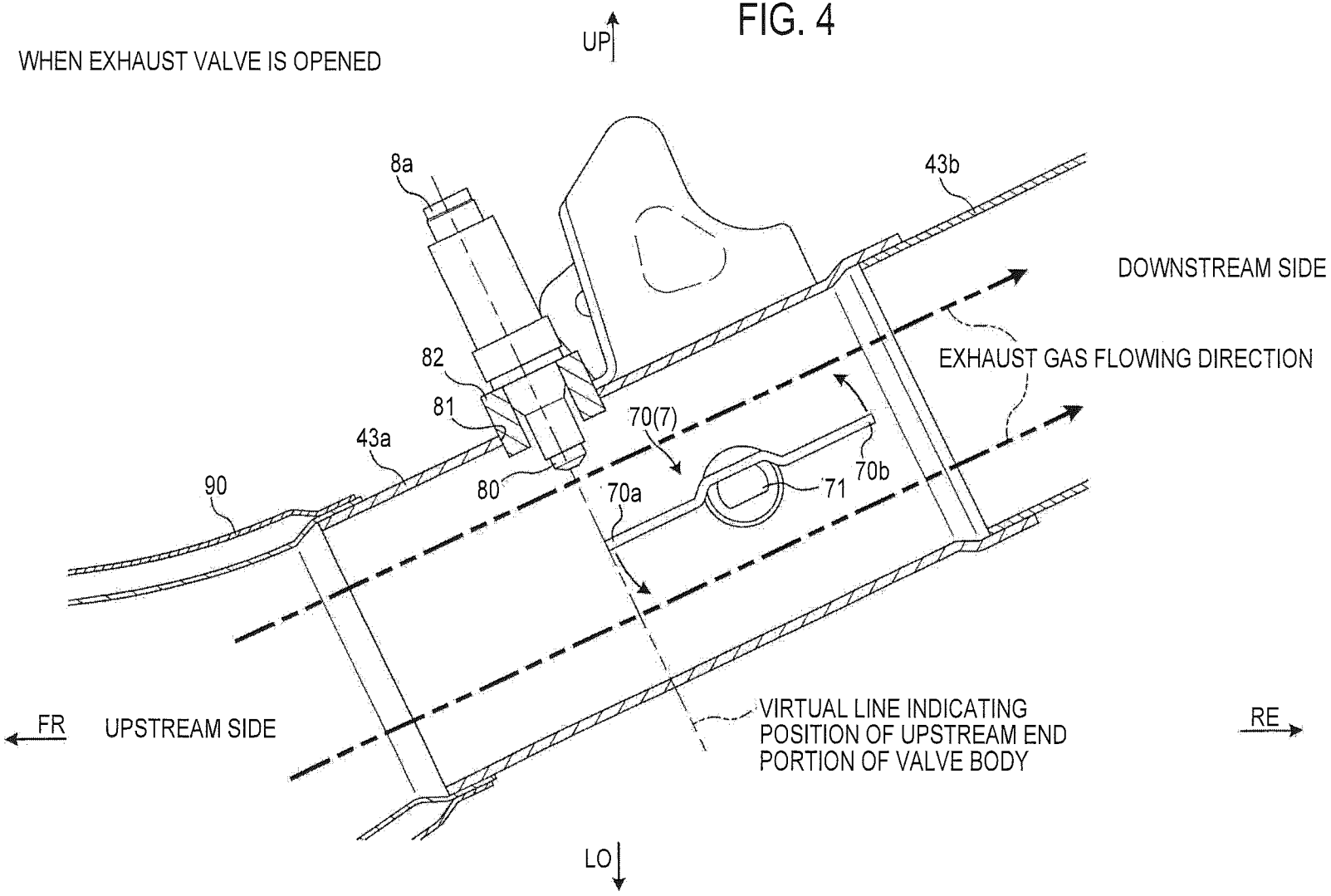
FIG. 4 is a cross-sectional view taken along line A-A in FIG. 3, illustrating a state in which an exhaust valve is opened.

Next, an exhaust control system and an exhaust gas sensor arrangement structure according to the present embodiment will be described with reference to FIGS. 2 to 4. FIG. 2 is a schematic perspective view of an exhaust system of a motorcycle according to a first embodiment. FIG. 3 is a partially enlarged view of FIG. 2. FIG. 4 is a cross-sectional view taken along line A-A in FIG. 3.

As illustrated in FIG. 2, an exhaust control system 6 includes an exhaust pipe 4 extending from the engine 3 (see FIG. 1) to form a part of an exhaust flow path, a muffler 5 connected to a downstream end of the exhaust pipe 4, an exhaust valve 7 that adjusts an aperture of the exhaust flow path, a first exhaust gas sensor 8*a* and a second exhaust gas sensor 8*b* that detect a predetermined component in an exhaust gas flowing through the exhaust flow path, a catalyst device 9 that purifies the exhaust gas, and an electronic control unit (ECU) 60 that executes opening and closing control of the exhaust valve 7.

The exhaust pipes 4 are constituted by bringing four exhaust pipes 4*a* to 4*d* into one by first collecting pipes 40*a* and 40*b* and a second collecting pipe 41, the four exhaust pipes 4*a* to 4*d* extending downward from the respective exhaust ports of the cylinder head. Here, the exhaust pipes are denoted by 4*a*, 4*b*, 4*c* and 4*d* from a right side in a vehicle width direction. The two exhaust pipes 4*a* and 4*b* on the right side are connected to and put together by the first collecting pipe 40*a* and the two exhaust pipes 4*c* and 4*d* on the left side are connected to and put together by the first collecting pipe 40*b*. The first collecting pipes 40*a* and 40*b* are connected to and put together by the second collecting pipe 41.

A tapered pipe 42 that is reduced and then expanded in diameter is connected to a downstream end of the second collecting pipe 41. The second exhaust gas sensor 8*b*, which will be described below, is provided in a straight portion in a center of the tapered pipe 42. The catalyst device 9 is connected to a downstream end of the tapered pipe 42. The catalyst device 9 is constituted by, for example, a three-way catalyst, and is constituted by accommodating a cylindrical honeycomb portion 91 in a tubular catalyst case 90. The honeycomb portion 91 absorbs pollutants (carbon monoxide, hydrocarbon, nitrogen oxide, or the like) in the exhaust gas and converts the pollutants into harmless substances (carbon dioxide, water, nitrogen, or the like). A downstream end of the catalyst case 90 is slightly bent rightward and rearward. Although details will be described below, the catalyst device 9 is arranged below the engine 3 (see FIG. 1) and is arranged between the first exhaust gas sensor 8*a* and the second exhaust gas sensor 8*b* in the middle of the exhaust pipe 4.

A connecting pipe 43 is connected to the downstream end of the catalyst case 90, the connecting pipe 43 is composed of three pipes 43*a* to 43*c* connected together. An upstream portion (the pipe 43*a* disposed on an uppermost stream among the three pipes) of the connecting pipe 43 is provided with the first exhaust gas sensor 8*a* and the exhaust valve 7 to be described below. The muffler 5 is connected to a downstream end of the connecting pipe 43. Note that, in the present embodiment, the entire configuration from the four exhaust pipes 4*a* to 4*d* to the connecting pipe 43 is referred to as one exhaust pipe 4. The exhaust pipe 4 and the muffler 5 form the exhaust flow path for discharging the exhaust gas from the engine.

The first exhaust gas sensor 8*a* and the second exhaust gas sensor 8*b* (hereinafter may be collectively referred to as exhaust gas sensors) that detect a predetermined component in the exhaust gas flowing through the exhaust flow path are arranged in front of and behind the catalyst device 9. Each of the exhaust gas sensors 8*a* and 8*b* is constituted by, for example, a zirconia-type oxygen sensor, and an output (current value) varies according to the oxygen concentration in the exhaust gas. The current value is output to the electronic control unit (ECU) 60. Note that the exhaust gas sensors 8*a* and 8*b* are not limited to the oxygen sensors, and may be, for example, air-fuel ratio sensors.

The exhaust gas sensors 8*a* and 8*b* are formed in a columnar shape having a predetermined length (see FIG. 4), and has one end side serving as a detector 80 (see FIG. 4) and the other end side connected with wiring (not illustrated). Each of the exhaust gas sensors 8*a* and 8*b* penetrates the exhaust pipe 4 and is arranged such that the detector 80 protrudes into the exhaust flow path. Specifically, as illustrated in FIG. 4, a through hole 81 is formed in an outer surface of the exhaust pipe 4 (the connecting pipe 43 or the tapered pipe 42), and a nut 82 is welded to close the through hole 81. Each of the exhaust gas sensors 8*a* and 8*b* (a detector 80 side) is fixed by being screwed into the nut 82 (only the first exhaust gas sensor 8*a* is illustrated in FIG. 4). Since the detector 80 protrudes into the exhaust flow path, the exhaust gas flowing through the exhaust flow path can be detected by the exhaust gas sensors 8*a* and 8*b*. Note that an axial direction of the first exhaust gas sensor 8*a* is slightly inclined forward with respect to a vertical direction and an axial direction of the second exhaust gas sensor 8*b* is oriented in the right and left direction.

The exhaust valve 7 adjusts the aperture of the exhaust flow path, and is provided on the connecting pipe 43 (pipe 43*a*) on a downstream side of the first exhaust gas sensor 8*a*. The exhaust valve 7 is constituted by a butterfly valve, for example. Specifically, the exhaust valve 7 includes a plate-like valve body 70 that expands and reduces (an area of) a flow path cross section of the exhaust flow passage, a rotating shaft 71 extending in a direction intersecting with an axial direction of the exhaust flow path and serving as a rotation center of the valve body, and an actuator 73 that drives the valve body 70 via a wire 72 in response to a command from the ECU 60.

The valve body 70 is formed in a disk shape having a complementary shape in an inner diameter of the pipe 43*a*, and the rotating shaft 71 is provided to pass through a diameter portion of the valve body 70. The rotating shaft 71 is arranged in a center of the valve body 70 in a plane orthogonal to a thickness direction of the valve body 70.

Further, an axial direction of the rotating shaft 71 is oriented in a direction orthogonal to the axial direction of the exhaust flow path (an extending direction of the pipe 43*a*). The rotating shaft 71 penetrates the pipe 43*a*, and an actuator 73 is provided at an end portion of the rotating shaft 71 on a right side surface of the pipe 43*a*. One end of the wire 72 is connected to the actuator 73, and the valve body 70 is rotatable around the rotating shaft 71 by pushing and pulling the wire 72. The other end of the wire 72 is connected to the vehicle body side and is connected to a vehicle body side actuator (not illustrated) separately provided on the vehicle body side. The vehicle body side actuator is electrically controlled by the ECU 60.

The exhaust valve 7 constituted as described above rotates the valve body 70 around the rotating shaft 71 in response to a command of the ECU 60 to expand or reduce the sectional area of the exhaust flow path to adjust the aperture of the exhaust flow path. Thereby, the exhaust valve 7 can adjust a flow rate and a flow speed of the exhaust gas flowing through the exhaust flow path. Note that the positional relationship between the exhaust valve 7 and the first exhaust gas sensor 8*a* will be described below in detail.

The ECU 60 collectively controls various operations in the motorcycle 1. The ECU 60 is constituted by a processor that executes various types of processing in the motorcycle 1, a memory, and the like. The memory is constituted by storage media such as a read only memory (ROM) and a random access memory (RAM) depending on use. In the memory, a control program for controlling each part of the motorcycle 1 and the like are stored. In particular, in the present embodiment, the ECU 60 performs opening and closing control of the exhaust valve 7 and predetermined control using detection results of the first exhaust gas sensor 8*a* and the second exhaust gas sensor 8*b*.

Examples of the predetermined control include feedback control (may be referred to as O2 feedback control) to adjust a fuel injection quantity of the engine 3 (see FIG. 1), deterioration determination of the catalyst device 9, and deterioration determination of the first exhaust gas sensor 8*a* and/or the second exhaust gas sensor 8*b*. For example, the feedback control is control to adjust a target output of the second exhaust gas sensor 8*b* to set an air-fuel ratio so that the output of the first exhaust gas sensor 8*a* converges to a target output, and to adjust a fuel injection correction quantity. Further, in the feedback control, a target exhaust valve aperture is set according to a traveling condition of the vehicle, and the driving of the exhaust valve 7 is appropriately controlled. Note that the predetermined control is not limited thereto, and another control may be performed on the basis of the detection results of the exhaust gas sensors.

By the way, as described above, the motorcycle exhaust system of the vehicle engine is required to monitor a deterioration state of the catalyst as an exhaust gas purification device with the recent emission control. To perform the deterioration determination of the catalyst, exhaust gas sensors need to be installed upstream and downstream of the catalyst.

For example, detecting the oxygen concentration in the exhaust gas by the exhaust gas sensor (oxygen sensor) provided on the upstream side of the catalyst and controlling the air-fuel ratio has been conventionally performed. However, in attempting to arrange the exhaust gas sensor on the downstream side of the catalyst for the purpose of the deterioration determination of the catalyst, arranging the exhaust gas sensor while ensuring predetermined detection accuracy has been difficult due to restriction of a layout peculiar to the motorcycle.

Therefore, the inventor of the present invention has arrived at the present invention, focusing on the positional relationship between the exhaust gas sensor and the exhaust valve that adjusts an exhaust flow rate. For example, in the case of arranging the exhaust gas sensor close to an upstream side or a downstream side of the exhaust valve and detecting the exhaust gas by the exhaust gas sensor, the exhaust valve is driven in a closing direction. At this time, the exhaust gas is guided to the exhaust gas sensor with the exhaust valve serving as a guide wall. As a result, the exhaust gas positively flows toward the exhaust gas sensor. Therefore, the detection accuracy of the exhaust gas sensor can be improved.

Figure 5:
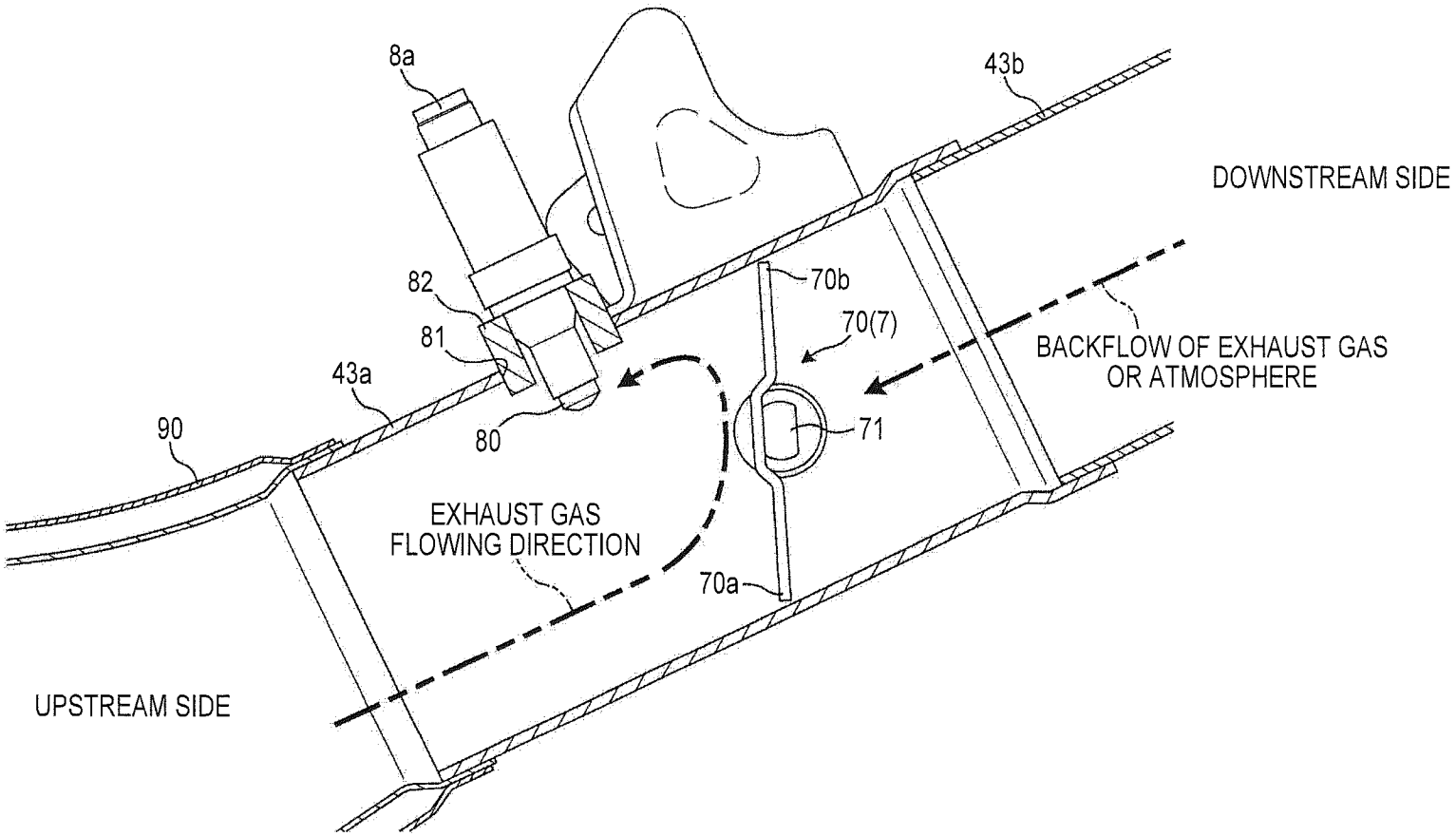
FIG. 5 is a cross-sectional view taken along line A-A in FIG. 3, illustrating a state in which the exhaust valve is closed.

Here, a detailed layout around the exhaust gas sensor and the exhaust valve will be described with reference to FIGS. 4 and 5. FIG. 4 is a cross-sectional view taken along line A-A in FIG. 3, illustrating a state in which the exhaust valve is opened (the aperture 100%). FIG. 5 is a cross-sectional view taken along line A-A in FIG. 3, illustrating a state in which the exhaust valve is closed (the aperture 0%). Note that the opening and closing diagrams of the exhaust valve illustrated in FIGS. 4 and 5 are mere examples, and the aperture of the exhaust valve can be serially adjusted between the aperture 0% to the aperture 100%.

In the first embodiment, the exhaust valve 7 and the first exhaust gas sensor 8*a* are arranged in the middle of the exhaust pipe 4 (see FIG. 2). Specifically, as illustrated in FIGS. 4 and 5, the exhaust valve 7 is arranged such that the rotating shaft 71 passes through the center of the pipe 43*a* that constitutes the connecting pipe 43 on a downstream side of the pipe 43*a*. Further, the rotating shaft 71 extends in a direction orthogonal to the axial direction of the first exhaust gas sensor 8*a*. As illustrated in FIG. 4, in the state where the exhaust valve 7 is opened, a plane direction of the valve body 70 is parallel to the axial direction of the exhaust flow path. Here, an upstream-side end portion (edge portion) of the valve body 70 is referred to as an upstream end portion 70*a*, and a downstream-side end portion (edge portion) of the valve body 70 is referred to as a downstream end portion 70*b*.

The first exhaust gas sensor 8*a* is arranged on the upstream side of the rotating shaft 71 and on the upstream side with respect to a substantially center in a front and rear direction of the pipe 43*a* such that the detector 80 penetrates the pipe 43*a* from above. In an open state of the exhaust valve 7 illustrated in FIG. 4, the detector 80 is provided such that at least a part of the detector 80 is located, in the axial direction of the exhaust flow path, at the same position as or on a downstream side with respect to the upstream end portion 70*a* of the valve body 70. Furthermore, the detector 80 and the upstream end portion 70*a* of the valve body 70 are in a positional relationship of facing each other in a direction orthogonal to the axial direction of the exhaust flow path (the axial direction of the first exhaust gas sensor 8*a*).

For example, in the case of adjusting the flow rate of the exhaust gas flowing through the pipe 43*a* (exhaust flow path), the valve body 70 is rotated around the rotating shaft 71. In this way, the exhaust valve 7 is normally driven to open or close to adjust the exhaust flow rate. However, in the present embodiment, the exhaust valve 7 is driven in a closing direction in the case of detecting an exhaust gas component by the first exhaust gas sensor 8*a*, regardless of the adjustment of the exhaust flow rate. As a result, a flow direction of the exhaust gas is changed and the exhaust gas can be guided toward the detector 80.

Specifically, as illustrated in FIGS. 4 and 5, the valve body 70 is rotationally driven such that the downstream end portion 70*b* approaches the detector 80. That is, the downstream end portion 70*b* of the valve body 70 approaches the detector 80 as the valve body 70 is rotated in a direction of reducing the flow path cross section (sectional area) of the exhaust flow path. At this time, the upstream end portion 70*a* of the valve body 70 moves away from the detector 80 while approaching an inner side surface of the pipe 43*a* on an opposite side of the detector 80.

As illustrated in FIG. 5, in a state where the downstream end portion 70*b* approaches the detector 80 and the exhaust valve 7 is closed, the exhaust gas flowing from the upstream side is bent in the flow path from the upstream end portion 70*a* side toward the downstream end portion 70*b* with the valve body 70 serving as a wall. After that, the exhaust gas is bent in the flow path from the downstream end portion 70*b* toward the front along the inner side surface of the pipe 43*a*, and flows toward the detector 80.

In this manner, the valve body 70 constitutes a guide wall that guides the exhaust gas to the first exhaust gas sensor 8*a*. For this reason, even the exhaust gas flowing at a location distant from the first exhaust gas sensor 8*a* can be guided to positively flow toward the detector 80, and the detection accuracy of the exhaust gas component can be enhanced. In addition, since the flow rate of the exhaust gas around the first exhaust gas sensor 8*a* is also adjusted by closing the exhaust valve 7, output characteristics of the first exhaust gas sensor 8*a* are stabilized and more accurate detection becomes possible.

In particular, in the state illustrated in FIG. 5, since the exhaust valve 7 is closed, the returning exhaust gas (for example, the exhaust gas due to pulsation) and atmosphere from the downstream side of the exhaust valve 7 are blocked by the valve body 70. Therefore, the returning exhaust gas and atmosphere do not flow (backflow) into the upstream side (the detector 80 side) of the valve body 70, and detection of the exhaust gas component is not impeded. Therefore, it is not necessary to arrange the first exhaust gas sensor 8*a* away from an exhaust downstream end in consideration of the backflow of the exhaust gas and the atmosphere. As a result, the degree of freedom of arrangement of the first exhaust gas sensor 8*a* is increased, and even in the case of a so-called short-type muffler having a short exhaust pipe on a downstream side of the catalyst, the first exhaust gas sensor 8*a* can be arranged without impairing the detection accuracy of the exhaust gas component.

Further, by arranging the exhaust valve 7 on the downstream side of the catalyst device 9, the flow rate of the exhaust gas can be decreased on the downstream side of the catalyst device 9 when the exhaust valve 7 is closed. As a result, the exhaust gas is difficult to blow through the catalyst device 9 (easy to stay), and purification of the exhaust gas can be promoted.

Further, as described above, the exhaust control system 6 performs the predetermined control such as the feedback control of the fuel injection quantity, the deterioration determination of the catalyst device 9, and the deterioration determination of the exhaust gas sensors 8*a* and 8*b*, using the detection results of the exhaust gas sensors 8*a* and 8*b*. When executing the predetermined control, the exhaust valve 7 is controlled in the closing direction, as compared with the case of not performing the predetermined control. As described above, since the detection accuracy of the first exhaust gas sensor 8*a* is enhanced by the driving of the exhaust valve 7, the predetermined control can be more suitably performed.

Note that the control of the exhaust valve 7 can be performed in consideration of the valve aperture before the control, the traveling feeling of the vehicle, and the like. For example, in the case where obtainment of satisfactory detection conditions can be presumed even if the exhaust valve 7 is not closed, such as a case where the exhaust gas sufficiently hits the exhaust gas sensor, the exhaust valve 7 may be controlled in the opening direction. By controlling the aperture of the exhaust valve 7 according to the state of the vehicle in this way, the detection of the exhaust gas component and the predetermined control using the detection result can be appropriately performed as needed while maintaining the original output characteristics and traveling feeling.

Figure 6A:
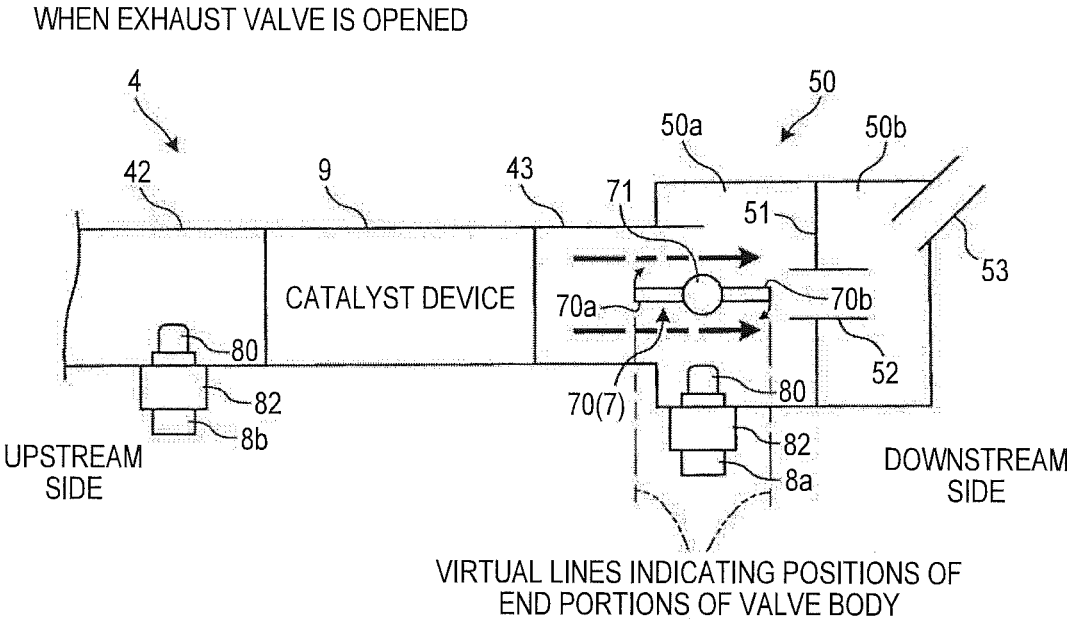
FIGS. 6A and 6B are schematic diagrams illustrating an arrangement structure of exhaust gas sensors according to a second embodiment.
Figure 6B:
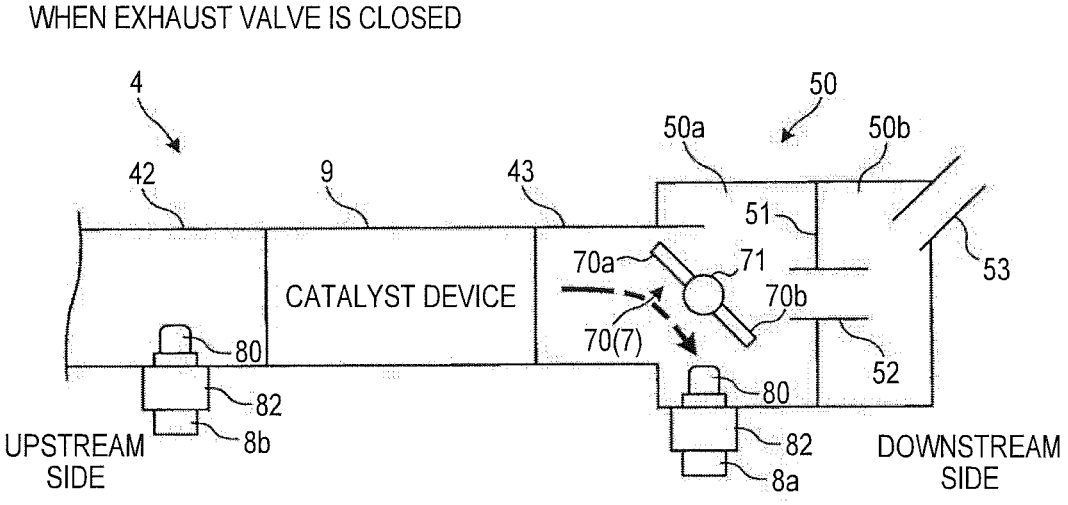

Next, an exhaust gas sensor arrangement structure according to a second embodiment will be described with reference to FIGS. 6A and 6B. FIGS. 6A and 6B are schematic diagrams illustrating the exhaust gas sensor arrangement structure according to the second embodiment. FIG. 6A illustrates a state in which an exhaust valve is opened, and FIG. 6B illustrates a state in which the exhaust valve is closed. Note that the second embodiment is different from the first embodiment in connecting a chamber to an exhaust pipe and arranging an exhaust valve and an exhaust gas sensor in the chamber. Hereinafter, different points will be mainly described, and the already described configurations are omitted as appropriate. Note that, in the second embodiment, the exhaust valve and the exhaust gas sensor may be arranged in a muffler in place of the chamber. Further, the muffler may be connected to a downstream side of the chamber.

As illustrated in FIGS. 6A and 6B, a chamber 50 is connected to an exhaust pipe 4 (connecting pipe 43) on a downstream side of a catalyst device 9. The chamber 50 is formed in a box shape expanding with respect to the connecting pipe 43. A predetermined expansion chamber formed in the chamber 50 is divided into two front and rear chambers (a first chamber 50*a* and a second chamber 50*b*) by a partition wall 51. A communicating pipe 52 that allows the first chamber 50*a* to communicate with the second chamber 50*b* is provided in a center of the partition wall 51. A tail pipe 53 communicating with a muffler (not illustrated) is connected to a rear end of the second chamber 50*b* located on a downstream side of the chamber 50.

An exhaust valve 7 and a first exhaust gas sensor 8*a* are arranged near a connection portion between the connecting pipe 43 and the chamber 50, that is, at an upstream end of the chamber 50. Specifically, the exhaust valve 7 is arranged such that a rotating shaft 71 is located near an entrance of the first chamber 50*a* on extension of an axis center of the connecting pipe 43.

The first exhaust gas sensor 8*a* is attached from a side surface of the chamber 50, the side surface forming the first chamber 50*a*, and a detector 80 protrudes into the first chamber 50*a*. A distal end of the detector 80 protrudes at substantially the same position as an outer surface of the connecting pipe 43 or protrudes radially outside with respect to the outer surface of the connecting pipe 43. Note that the distal end of the detector 80 may protrude radially inside with respect to the outer surface of the connecting pipe 43. Further, in an open state of the exhaust valve 7, the detector 80 is provided such that at least a part of the detector 80 is located, in an axial direction of an exhaust flow path, at a downstream side with respect to an upstream end portion 70*a* of a valve body 70, and at an upstream side with respect to a downstream end portion 70*b*. Furthermore, the rotating shaft 71 and the detector 80 are in a positional relationship of facing each other in a direction orthogonal to the axial direction of the exhaust flow path (an axial direction of the first exhaust gas sensor 8*a*).

As illustrated in FIG. 6A, in the state where the exhaust valve 7 is opened, a plane direction of the valve body 70 is parallel to the axial direction of the exhaust flow path. In this case, the exhaust gas having passed through the catalyst device 9 flows into the chamber 50 without being blocked by the valve body 70, passes through the first chamber 50*a*, the communicating pipe 52, and the second chamber 50*b*, and then flows into the muffler through the tail pipe 53.

In the case of detecting an exhaust gas component by the first exhaust gas sensor 8*a*, the valve body 70 is rotationally driven such that the downstream end portion 70*b* approaches the detector 80, as illustrated in FIG. 6B. That is, the downstream end portion 70*b* of the valve body 70 approaches the detector 80 as the valve body 70 is rotated in a direction of reducing a flow path cross section (sectional area) of the exhaust flow path. In this case, when flowing into the chamber 50 (first chamber 50*a*), the exhaust gas flowing from the upstream side is bent in the flow path toward the downstream end portion 70*b* from the upstream end portion 70*a* side with the valve body 70 serving as a wall. Since the downstream end portion 70*b* is close to the detector 80, the exhaust gas can be guided toward the detector 80.

As described above, even in the second embodiment, since the valve body 70 constitutes the guide wall that guides the exhaust gas to the first exhaust gas sensor 8*a*, the exhaust gas can be guided to positively flow toward the detector 80, and detection accuracy of the exhaust gas component can be enhanced.

Note that, in the case of arranging the first exhaust gas sensor 8*a* in the muffler, similar effects can be obtained by attaching the first exhaust gas sensor 8*a* from a side surface of the muffler, the side surface forming a first chamber (first expansion chamber), similarly to the above-described chamber.

Figure 7A:
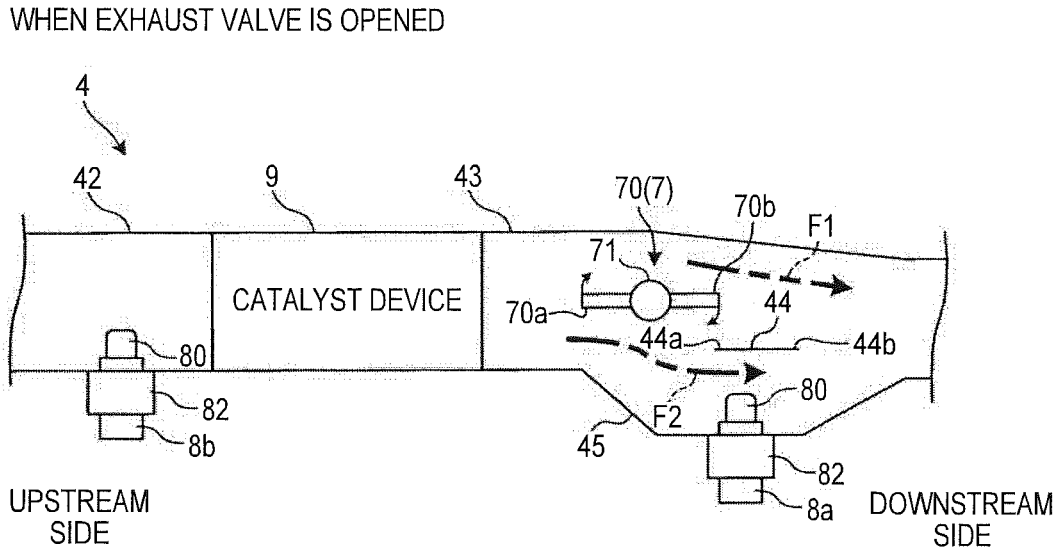
FIGS. 7A and 7B are schematic diagrams illustrating an arrangement structure of exhaust gas sensors according to a third embodiment.
Figure 7B:
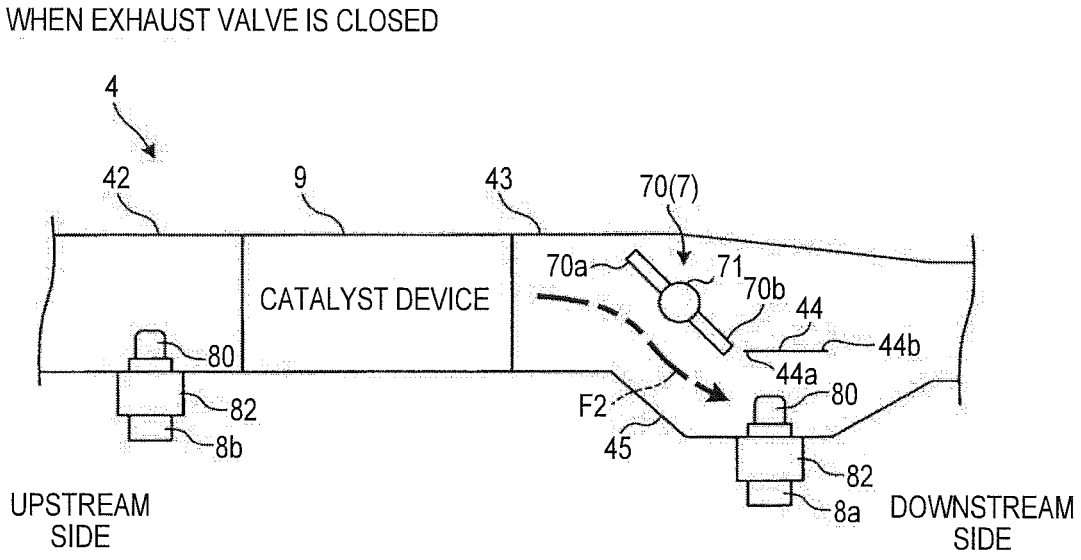

Next, an exhaust gas sensor arrangement structure according to a third embodiment will be described with reference to FIGS. 7A and 7B. FIGS. 7A and 7B are schematic diagrams illustrating the exhaust gas sensor arrangement structure according to the third embodiment. FIG. 7A illustrates a state in which an exhaust valve is opened, and FIG. 7B illustrates a state in which the exhaust valve is closed. Note that the third embodiment is different from the first embodiment in that an exhaust pipe (connecting pipe) in which an exhaust valve and an exhaust gas sensor are arranged is branched into two flow paths by a branch portion (a branch wall to be described below). Hereinafter, different points will be mainly described, and the already described configurations are omitted as appropriate.

As illustrated in FIGS. 7A and 7B, a branch wall 44 is provided inside a connecting pipe 43 connected to a downstream side of a catalyst device 9, the branch wall 44 serving as a branch portion that branches an exhaust flow path into two flow paths. The branch wall 44 is formed to extend in a front and rear direction from an upstream side toward a downstream side. A protrusion 45 protruding (expanding) in a radial direction is formed in the middle of the connecting pipe 43. The protrusion 45 is provided at a position corresponding to the branch wall 44. That is, the branch wall 44 extends within a range of the front and rear direction of the protrusion 45. An upstream end portion 44*a* of the branch wall 44 is located at a downstream side with respect to an upstream end of the protrusion 45, and a downstream end portion 44*b* of the branch wall 44 is located at an upstream side with respect to a downstream end of the protrusion 45.

The exhaust flow path in the connecting pipe 43 is branched by the branch wall 44 into a first exhaust flow path F1 passing on an opposite side of a protruding direction of the protrusion 45, and a second exhaust flow path F2 passing on the protrusion 45 side. The second exhaust flow path F2 joins the first exhaust flow path F1 at the downstream end (branch wall 44) of the protrusion 45.

A first exhaust gas sensor 8*a* is arranged in the protrusion 45. Specifically, the first exhaust gas sensor 8*a* is attached from a side surface of the protrusion 45, and detector 80 protrudes into the protrusion 45 (connecting pipe 43). The detector 80 is arranged to face the branch wall 44 in a direction orthogonal to an axial direction of the connecting pipe 43. More specifically, a distal end of the detector 80 is directed (brought close) to the upstream end portion 44*a* of the branch wall 44.

An exhaust valve 7 is arranged at an upstream side of the detector 80 and the branch wall 44 in the connecting pipe 43. Specifically, the exhaust valve 7 is arranged on an upstream end side of the protrusion 45 such that a rotating shaft 71 is located on extension of an axis center of the connecting pipe 43. That is, the rotating shaft 71 is located on an upstream side with respect to the upstream end portion 44*a* of the branch wall 44.

As illustrated in FIG. 7A, in a state where the exhaust valve 7 is opened, a plane direction of a valve body 70 is parallel to an axial direction of the exhaust flow path, and a downstream end portion 70*b* of the valve body 70 faces the upstream end portion 44*a* of the branch wall 44 in a direction orthogonal to the flow path. In this case, an exhaust gas having passed through a catalyst device 9 flows into a downstream side through the first exhaust flow path F1 and the second exhaust flow path F2 without being blocked by the valve body 70.

In the case of detecting an exhaust gas component by the first exhaust gas sensor 8*a*, the valve body 70 is rotationally driven such that the downstream end portion 70*b* approaches the upstream end portion 44*a* of the branch wall 44 (the detector 80), as illustrated in FIG. 7B. That is, the downstream end portion 70*b* of the valve body 70 approaches the upstream end portion 44*a* of the branch wall 44 (detector 80) as the valve body 70 is rotated in a direction of reducing a flow path cross section (sectional area) of the exhaust flow path.

At this time, an upstream end portion 70*a* of the valve body 70 moves away from the detector 80 while approaching an inner side surface of a pipe 43*a* on an opposite side of the detector 80. Therefore, the first exhaust flow path F1 is blocked by the valve body 70. The exhaust gas flowing from the upstream side is bent in the flow path with the valve body 70 serving as a wall, and flows toward the protrusion 45. That is, the exhaust gas flows into the downstream side only through the second exhaust flow path F2. The flow path of the exhaust gas can be guided toward the detector 80 as the downstream end portion 70*b* of the valve body 70 approaches the upstream end portion 44*a* of the branch wall 44.

As described above, even in the third embodiment, since the valve body 70 constitutes the guide wall that guides the exhaust gas to the first exhaust gas sensor 8*a*, the exhaust gas can be guided to positively flow toward the detector 80, and detection accuracy of the exhaust gas component can be enhanced.

As described above, according to the present invention, in the case of arranging the exhaust gas sensor close to the upstream side or the downstream side of the exhaust valve and detecting the exhaust gas by the exhaust gas sensor, the exhaust valve is driven in a closing direction. That is, the valve body 70 is rotationally driven such that the downstream end portion 70*b* approaches the detector 80. Therefore, the exhaust gas is guided to the exhaust gas sensor with the exhaust valve serving as the guide wall. As a result, the exhaust gas positively flows toward the exhaust gas sensor, and thus the detection accuracy of the exhaust gas sensor can be improved. Further, the present invention can be appropriately applied according to a mode of the exhaust system without being restricted by the arrangement of the exhaust gas sensor.

Note that, in the above embodiment, the parallel four-cylinder engine 3 has been described as an example. However, the embodiment is not limited to this configuration. For example, the engine 3 may be constituted by a single cylinder engine or an engine of three or more cylinders, and arrangement of the cylinders is not limited to the parallel arrangement and may be appropriately changed.

Further, in the above embodiment, the vehicle body frame 2 has been constituted by the twin spar-type frame. However, the embodiment is not limited to this configuration. The vehicle body frame 2 may be, for example, a diamond-type frame or another type of frame.

Further, in the above-described embodiments, the positional relationship between the first exhaust gas sensor 8*a* and the exhaust valve 7 is merely exemplified, and the front-rear relationship between the first exhaust gas sensor 8*a* and the exhaust valve 7 can be appropriately changed. For example, in the first embodiment, the detector 80 is arranged on the upstream side of the rotating shaft 71. However, the detector 80 may be arranged at a position facing the rotating shaft 71 or at a downstream side of the rotating shaft 71. Similarly, in the second and third embodiments, the positional relationship between the first exhaust gas sensor 8*a* and the exhaust valve 7 can be appropriately changed.

Further, in the above-described embodiments, the configuration in which the first exhaust gas sensor 8*a* and the exhaust valve 7 are arranged close to each other has been described. However, an embodiment is not limited to this configuration. The second exhaust gas sensor 8*b* and the exhaust valve 7 may be arranged close to each other and constituted like the above-described embodiments.

Further, in the above-described embodiments, the example in which the exhaust valve 7 is set to a substantially fully closed state (open 0%) when detecting the exhaust gas component has been described. However, an embodiment is not limited to the example. The exhaust valve 7 just has to be closed such that the downstream end portion 70*b* of the valve body 70 approaches the detector 80 even if only slightly, and the aperture of the exhaust valve 7 can be appropriately changed such as the aperture 10%.

Further, in the above-described embodiments, the configuration in which the rotating shaft 71 of the valve body 70 passes through the center of the valve body 70 has been described. However, an embodiment is not limited to this configuration. For example, the rotating shaft 71 may be arranged to be biased toward one end side of the valve body 70.

The present embodiments and modifications have been described. However, as another embodiment of the present invention, the above embodiments and modifications may be combined as a whole or in part.

Further, the embodiments of the present invention are not limited to the above-described embodiments, and various changes, substitutions, and modifications may be made without departing from the spirit of the technical idea of the present invention. Furthermore, if the technical idea of the present invention can be realized by another method with advancement of technology or by another derivative technology, the technical idea of the present invention may be carried out using the method. Therefore, the claims are intended to cover all of embodiments that may fall within the scope of the technical idea of the present invention.

As described above, the present invention has the effect of arranging the exhaust gas sensor without impairing the detection accuracy of the exhaust gas component, and in particular, is useful for the exhaust gas sensor arrangement structure and the exhaust control system applicable to motorcycles.

What is claimed is:

1. An exhaust gas sensor arrangement structure comprising:

an exhaust pipe extending from an engine to form a part of an exhaust flow path;

an exhaust valve that adjusts an aperture of the exhaust flow path; and an exhaust gas sensor that detects a predetermined component in an exhaust gas flowing through the exhaust flow path, wherein the exhaust gas sensor has a detector arranged to protrude into the exhaust flow path, the exhaust valve includes:

a plate-like valve body that expands and reduces a flow path cross section of the exhaust flow path, a rotating shaft extending in a direction intersecting with an axial direction of the exhaust flow path and serving as a rotation center of the valve body, and a downstream end of the valve body approaches the detector as the valve body is rotated in a direction of reducing the flow path cross section, and the exhaust valve is rotated such that the downstream end of the valve body is located on a same side as the detector in the state where the exhaust valve is closed.

2. The exhaust gas sensor arrangement structure according to claim 1, wherein the valve body constitutes a guide wall to guide the exhaust gas to the exhaust gas sensor.

3. The exhaust gas sensor arrangement structure according to claim 1, wherein the rotating shaft is arranged in a center of the valve body in a plane orthogonal to a thickness direction of the valve body, and at least a part of the detector is arranged at a position facing the rotating shaft or on an upstream side of the rotating shaft.

4. The exhaust gas sensor arrangement structure according to claim 1, wherein the exhaust valve and the exhaust gas sensor are arranged in a middle of the exhaust pipe, and at least a part of the detector is arranged on an upstream side with respect to the rotating shaft.

5. The exhaust gas sensor arrangement structure according to claim 1, further comprising:

a chamber connected to a downstream end of the exhaust pipe, wherein the chamber has a shape expanding with respect to the exhaust pipe, and the exhaust valve and the exhaust gas sensor are arranged at an upstream end of the chamber.

6. The exhaust gas sensor arrangement structure according to claim 5, wherein the rotating shaft and at least a part of the detector are arranged to face each other.

7. The exhaust gas sensor arrangement structure according to claim 1, wherein a branch portion branching the exhaust flow path into a plurality of exhaust flow paths is provided in the exhaust pipe, at least a part of the detector is arranged to face the branch portion, and the exhaust valve is arranged on an upstream side of the detector, and the downstream end of the valve body approaches an upstream end of the branch portion as the valve body is rotated in a direction of reducing the flow path cross section.

8. The exhaust gas sensor arrangement structure according to claim 7, wherein the rotating shaft is arranged on an upstream side with respect to the upstream end of the branch portion.

9. The exhaust gas sensor arrangement structure according to claim 7, wherein the exhaust pipe includes a protrusion having a portion protruding in a predetermined direction, the portion corresponding to the branch portion, and the exhaust gas sensor is arranged in the protrusion.

10. The exhaust gas sensor arrangement structure according to claim 1, wherein the rotating shaft extends in a direction orthogonal to an axial direction of the exhaust gas sensor.

11. An exhaust control system comprising:

an exhaust gas sensor arrangement structure comprising:

an exhaust pipe extending from an engine to form a part of an exhaust flow path;

an exhaust valve that adjusts an aperture of the exhaust flow path; and an exhaust gas sensor that detects a predetermined component in an exhaust gas flowing through the exhaust flow path, wherein the exhaust gas sensor has a detector arranged to protrude into the exhaust flow path, wherein the exhaust valve includes:

a plate-like valve body that expands and reduces a flow path cross section of the exhaust flow path, and a rotating shaft extending in a direction intersecting with an axial direction of the exhaust flow path and serving as a rotation center of the valve body, and a downstream end of the valve body approaches the detector as the valve body is rotated in a direction of reducing the flow path cross section; and a control device that performs opening and closing control of the exhaust valve and a predetermined control using a detection result of the exhaust gas sensor, wherein the control device controls, in executing the predetermined control, the exhaust valve in a closing direction, as compared with a case of not executing the predetermined controls.

12. The exhaust control system according to claim 11, further comprising:

a second exhaust gas sensor that detects a predetermined component in the exhaust gas flowing through the exhaust flow path on an upstream side with respect to the exhaust gas sensor, wherein the control device performs the predetermined control using detection results of the exhaust gas sensor and the second exhaust gas sensor.

13. The exhaust control system according to claim 12, wherein the control device performs feedback control to adjust a fuel injection quantity of the engine, using the detection results of the exhaust gas sensor and the second exhaust gas sensor.

14. The exhaust control system according to claim 12, further comprising:

a catalyst device that purifies the exhaust gas, wherein the catalyst device is arranged between the exhaust gas sensor and the second exhaust gas sensor in a middle of the exhaust pipe, and the control device performs deterioration determination of the catalyst device, using the detection results of the exhaust gas sensor and the second exhaust gas sensor.

15. The exhaust control system according to claim 12, wherein the control device performs deterioration determination of the exhaust gas sensor and/or the second exhaust gas sensor, using the detection results of the exhaust gas sensor and the second exhaust gas sensor.

* * * * *